US011641953B2

(12) United States Patent
Farrell

(10) Patent No.: US 11,641,953 B2
(45) Date of Patent: May 9, 2023

(54) THREE-POSITION CHILD CARRIER

(71) Applicant: Kathryn Farrell, Atlanta, GA (US)

(72) Inventor: Kathryn Farrell, Atlanta, GA (US)

( * ) Notice: Subject to any disclaimer, the term of this patent is extended or adjusted under 35 U.S.C. 154(b) by 0 days.

(21) Appl. No.: 17/481,012

(22) Filed: Sep. 21, 2021

(65) Prior Publication Data

US 2022/0087444 A1 Mar. 24, 2022

Related U.S. Application Data

(60) Provisional application No. 63/082,367, filed on Sep. 23, 2020.

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02
See application file for complete search history.

(56) References Cited

U.S. PATENT DOCUMENTS 4,434,920 A * 3/1984 Moore ..... A47D 13/025 224/160
4,986,458 A * 1/1991 Linday ..... A47D 13/025 224/648
5,813,580 A * 9/1998 Fair ..... A47D 13/025 224/160
6,666,361 B1 * 12/2003 Lin ..... A47D 13/025 224/259
7,770,765 B2 * 8/2010 Stevens ..... A47D 13/025 224/159
9,179,758 B2 * 11/2015 Calilung ..... A47D 13/025
2004/0149790 A1 * 8/2004 Kassai ..... A47D 13/02 224/160

* cited by examiner

*Primary Examiner* — Derek J Battisti
(74) *Attorney, Agent, or Firm* — H. Brock Kolls

(57) ABSTRACT

The present invention relates to a three-position child carrier that transitions between a front-carry position, a back-carry position, and a hip-carry position. The three-position child carrier is a soft, buckle-style infant carrier that comprises separate components that include a shoulder strap, a waist strap, and a body portion that secures the child. In an exemplary embodiment, the shoulder strap and the waist strap slide through corresponding channels on the top and bottom of the body portion and attach in a variety of configurations. An advantage, in the present invention, is the ability to change the body portion and thus the body portion size to accommodate growing children and usage in different climates and weather conditions.

20 Claims, 9 Drawing Sheets

Fig. 4A
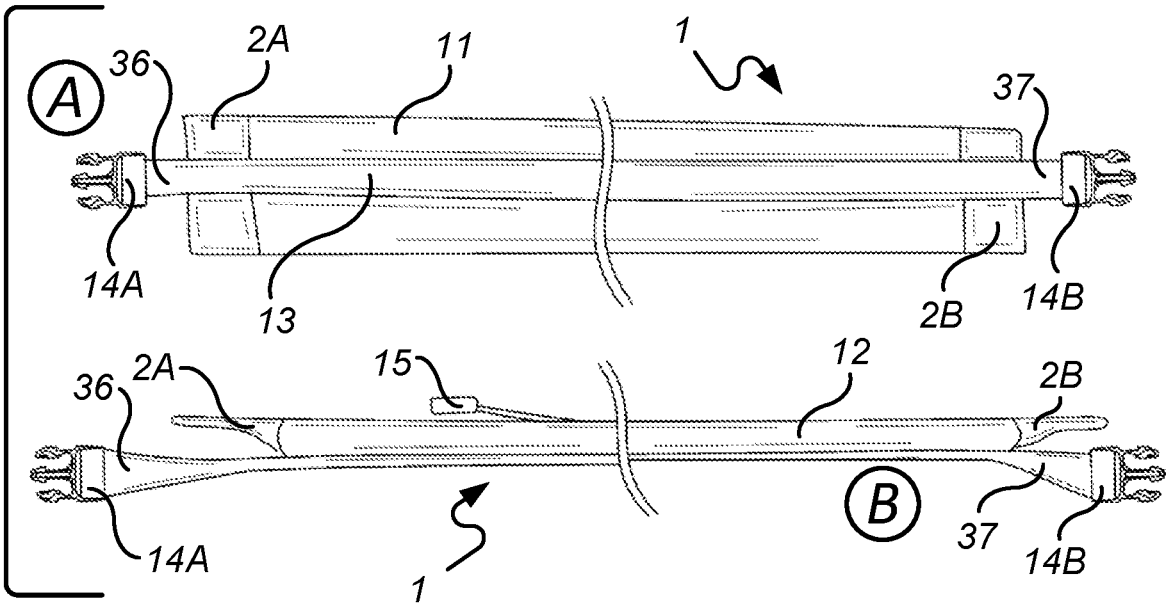
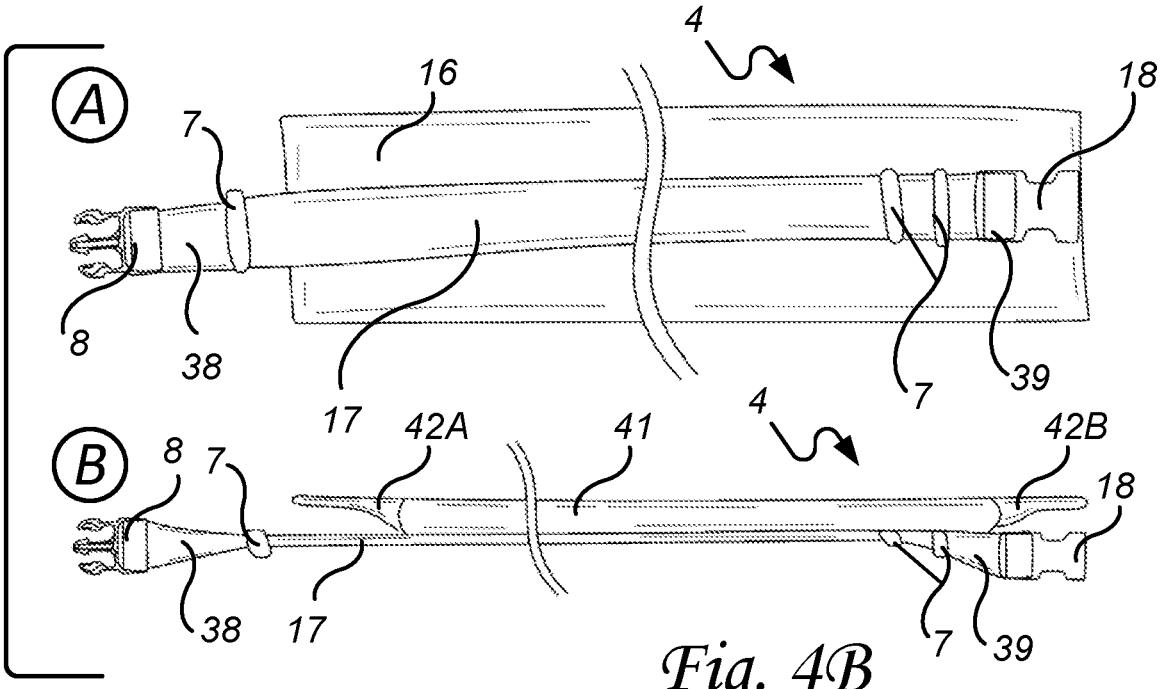
Fig. 4B

THREE-POSITION CHILD CARRIER

CROSS-REFERENCE TO RELATED APPLICATIONS

This application contains subject matter which is related to the subject matter of the following application. The below-listed application is hereby incorporated herein by reference in its entirety:

This is a U.S. non-provisional application that claims the benefit of a U.S. provisional application, Ser. No. 63/082,367, inventor Kathryn Farrell, entitled "THREE-PART BUCKLE STYLE SOFT INFANT CARRIER", filed Sep. 23, 2020.

TECHNICAL FIELD OF THE INVENTION

This invention relates to a three-position child carrier that transitions between a front-carry position, a back-carry position, and a hip-carry position. The three-position child carrier is a soft, buckle-style child carrier that comprises separate components that include a shoulder strap, a waist strap, and a body portion that secures the child. In an exemplary embodiment, the shoulder strap and the waist strap slide through a corresponding channel on the top and bottom of the body portion and attach in a variety of configurations. The body portion can be changed by the wearer for style, color, functionality, size, or for other reasons. The ability to change the body portion and thus the body portion size accommodates growing children and usage in different climates and weather conditions.

BACKGROUND OF THE INVENTION

Before our invention, infant carriers commonly worn by caregivers comprised one continuous piece of unchangeable material. In operation, to have a new style or a different material, a parent often purchased more than one type of infant carrier. In this regard, and a shortcoming of prior infant carriers is that more breathable, lightweight materials for warm weather leave a child unprotected from cooler weather. Also, thicker more insulating materials that keep the baby warm in the winter can be dangerous to wrap a child in during higher temperatures. While different infant carrier materials have different cooling, warming, wind-resistant, water-resistant, and other properties, the inability of a single infant carrier to be able to switch the use of different materials often leaves the mother and child ill-equipped or unable to use the infant carrier due to climate and/or weather conditions.

In addition to the limits for infant carrier use because of sub-optimal materials, the inability to easily swap materials also limits the parents' choice of different styles and patterns for expression of personal style, taste, and customization is also a shortcoming of the prior carriers.

Since the cost can be high for infant carriers, it is often unrealistic to expect parents to purchase more than one infant carrier to accommodate seasonal weather conditions and multiple style preferences. This absence of choice and customization options is further impaired when you add the need for different size infant carriers as the baby grows. The inability to correctly resize an infant carrier to the child being carried raises the danger of the child falling from the infant carrier. Also, carriers that are too small or too large create an uncomfortable fit for both the wearer and the infant.

Another shortcoming of the prior infant carriers is that many of the designs are highly complex, take a long time to set up for the parent wearing, and require multiple straps and adjustments for each carry position. While there are simpler carrier designs, the simpler designs often come with fewer adjustment features and often only support one or two wearing positions.

The simplest type of infant carrier, a fabric wrap, involves a complex wrapping technique that can be difficult to learn. Even once mastered, it takes time to adjust to perfection every single use to ensure the safety of the wearer and the child. Also, there are very few carriers that offer a hip-carry position, which reduces the stress on the back and shoulder of the person wearing the infant carrier. Those carriers offering hip-carry positions that are on the market are quite bulky and onerous to adjust.

The present invention addresses these and other shortcomings by providing a simple three-position child carrier design and structure with interchangeable parts and materials. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a three-position child carrier. The three-position child carrier comprising a body portion that comprises a front surface, a back surface, a top edge, a left edge, a right edge, a fold stitching, an upper channel stitching, a bottom channel stitching, and a bottom edge.

A first tether strap comprising a first shoulder strap buckle receiver on one end, the first tether strap is fastened to the body portion proximate to the left edge below the fold stitching. A second tether strap comprising a second shoulder strap buckle receiver on one end, the second tether strap is fastened to the body portion proximate to the right edge below the fold stitching.

An upper channel is formed between the fold stitching and the upper channel stitching. A lower channel is formed between the bottom edge and the bottom channel stitching.

A shoulder strap is fitted through the upper channel, the shoulder strap comprising a webbing strap having a first end, a second end, a first buckle secured to the first end, a second buckle secured to the second end, and a buckle receiver attached between the first buckle and the second buckle.

A waist strap is fitted through the lower channel, the waist strap comprising a waist webbing strap having a first waist webbing strap end and a second waist webbing strap end, a waist buckle is secured to the first waist webbing strap end and a waist buckle receiver is secured to the second waist webbing strap end, the waist buckle and the waist buckle receiver interconnect around the waist of a wearer. The waist buckle and/or the waist buckle receiver are slidably adjustable along the waist webbing strap to lengthen or shorten the waist webbing strap to create a good fit for the wearer.

Wherein the three-position child carrier transitions to a front-carry position by interconnecting the first shoulder strap buckle receiver and the second buckle and interconnecting the second shoulder strap buckle receiver and the first buckle in a crisscross pattern across the back of the wearer.

Or, wherein the three-position child carrier transitions to a back-carry position by interconnecting the first shoulder strap buckle receiver and the first buckle, and interconnecting the second shoulder strap buckle receiver and the second buckle over each shoulder of the wearer.

Or, wherein the three-position child carrier transitions to a hip-carry position by interconnecting the buckle receiver and the second buckle over one shoulder of the wearer.

Additional shortcomings of the prior art are overcome and additional advantages are provided through the provision of a three-position child carrier. The three-position child carrier comprising a body portion that is made of a flexible material, the body portion comprising a front surface, a back surface, a top edge, a left edge, a right edge, a fold stitching, an upper channel stitching, a bottom edge channel stitching, and a bottom edge.

A first tether strap comprising a first shoulder strap buckle receiver on one end, the first tether strap is fastened to the body portion proximate to the left edge below the fold stitching. A second tether strap comprising a second shoulder strap buckle receiver on one end, the second tether strap is fastened to the body portion proximate to the right edge below the fold stitching.

An upper channel is formed by folding the flexible material creating the top edge or adding a second piece of the flexible material and stitching along the fold stitching and the upper channel stitching. A lower channel is formed by folding the flexible material creating the bottom edge or adding a second piece of the flexible material and stitching along the bottom channel stitching and selectively stitching along the bottom edge.

A shoulder strap is fitted through the upper channel, the shoulder strap comprising a webbing strap having a first end, a second end, a first buckle secured to the first end, a second buckle secured to the second end, and a buckle receiver attached between the first buckle and the second buckle.

A waist strap is fitted through the lower channel, the waist strap comprising a waist webbing strap having a first waist webbing strap end and a second waist webbing strap end, a waist buckle is secured to the first waist webbing strap end and a waist buckle receiver is secured to the second waist webbing strap end, the waist buckle and the waist buckle receiver interconnect around the waist of a wearer. The waist buckle and/or the waist buckle receiver are slidably adjustable along the waist webbing strap to lengthen or shorten the waist webbing strap to create a good fit for the wearer.

Wherein the three-position child carrier transitions to a front-carry position by interconnecting the first shoulder strap buckle receiver and the second buckle and interconnecting the second shoulder strap buckle receiver and the first buckle in a crisscross pattern across the back of the wearer.

Or, wherein the three-position child carrier transitions to a back-carry position by interconnecting the first shoulder strap buckle receiver and the first buckle, and interconnecting the second shoulder strap buckle receiver and the second buckle over each shoulder of the wearer.

Or, wherein the three-position child carrier transitions to a hip-carry position by interconnecting the buckle receiver and the second buckle over one shoulder of the wearer.

Additional shortcomings of the prior art are overcome and additional advantages are provided through the provision of a method of using a three-position child carrier. The method comprising the steps of transitioning a three-position child carrier to a front-carry position by interconnecting a first shoulder strap buckle receiver and a second buckle, and interconnecting a second shoulder strap buckle receiver and the first buckle in a crisscross pattern across the back of the wearer.

A body portion comprising a front surface, a back surface, a top edge, a left edge, a right edge, a fold stitching, an upper channel stitching, a bottom channel stitching, and a bottom edge.

A first tether strap comprising a first shoulder strap buckle receiver on one end, the first tether strap is fastened to the body portion proximate to the left edge below the fold stitching. A second tether strap comprising a second shoulder strap buckle receiver on one end, the second tether strap is fastened to the body portion proximate to the right edge below the fold stitching.

An upper channel is formed between the fold stitching and the upper channel stitching. A lower channel is formed between the bottom edge and the bottom channel stitching.

A shoulder strap is fitted through the upper channel, the shoulder strap comprising a webbing strap having a first end, a second end, the first buckle secured to the first end, the second buckle secured to the second end, and a buckle receiver attached between the first buckle and the second buckle.

Or, transitioning the three-position child carrier to a back-carry position by interconnecting the first shoulder strap buckle receiver and the first buckle, and interconnecting the second shoulder strap buckle receiver and the second buckle over each shoulder of the wearer.

Or, transitioning the three-position child carrier to a hip-carry position by interconnecting the buckle receiver and the second buckle over one shoulder of the wearer.

And, securing a waist strap around the waist of a wearer, the waist strap is fitted through the lower channel. The waist strap comprising a waist webbing strap having a first waist webbing strap end and a second waist webbing strap end. A waist buckle is secured to the first waist webbing strap end and a waist buckle receiver is secured to the second waist webbing strap end. The waist buckle and the waist buckle receiver interconnect.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The foregoing and other objects, features, and advantages of the invention are apparent from the following detailed description taken in conjunction with the accompanying drawings in which:

FIG. 4A illustrates one example of reference 'A' a top view of a shoulder strap, and reference 'B' a side view of a shoulder strap;

FIG. 4B illustrates one example of reference 'A' a top view of a waist strap, and reference 'B' a side view of the waist strap;

The detailed description explains the preferred embodiments of the invention, together with advantages and features, by way of example with reference to the drawings.

DETAILED DESCRIPTION OF THE INVENTION

The three-position child carrier of the present invention provides a simple child carrier design and structure which incorporates interchangeable parts and materials. Incorporating interchangeable parts and materials makes the setup, adjustment, and changing between positions much easier for parents and safer for the child being carried.

The interchangeable parts and materials allow for wearers of the three-position child carrier to have multiple body portions that better fit a growing child, without the use of an infant insert which is a device designed to occupy excess space within the infant receiving portion of the carrier. Also, the three-position child carrier is better suited for use year-round in different climates and weather conditions. Providing additional consumer benefits, the three-position child carrier, of the present invention, is easily stylized and customizable to meet the tastes, interests, needs, and comfort preferences of the parents as well as the children being carried.

An advantage, in the present invention, is that the design and structure minimize straps, buckles, or other fasteners. Minimizing straps, buckles, and other fasteners reduces the adjustment time and the complexity of the straps which in turn allows for quicker transitions between wearers and children of different sizes. The flexibility of the fabric materials and its ability to slide over the waist strap also allows for an easier adjustment for healthy child hip positioning without additional buttons or straps.

Another advantage, in the present invention, is the unique design that allows the shoulder strap to attach to the body piece in two different patterns for front-carry or back-carry positions as well as attach to itself for the hip-carry position.

Another advantage, in the present invention, is a method by which the straps can be easily removed from the body portion and attached to another body portion, allowing for the wearer to change body portions of the infant carrier for additional utility and comfort.

The shortcoming of prior art baby carriers' poor child body fit for the full range of child sizes is overcome and is an advantage, in the present invention, by the ability to retain the waist strap and shoulder strap and change only the body portion to a different size as the child grows. This allows for a snugger fit at each stage of the child's growth development.

Figure 1:
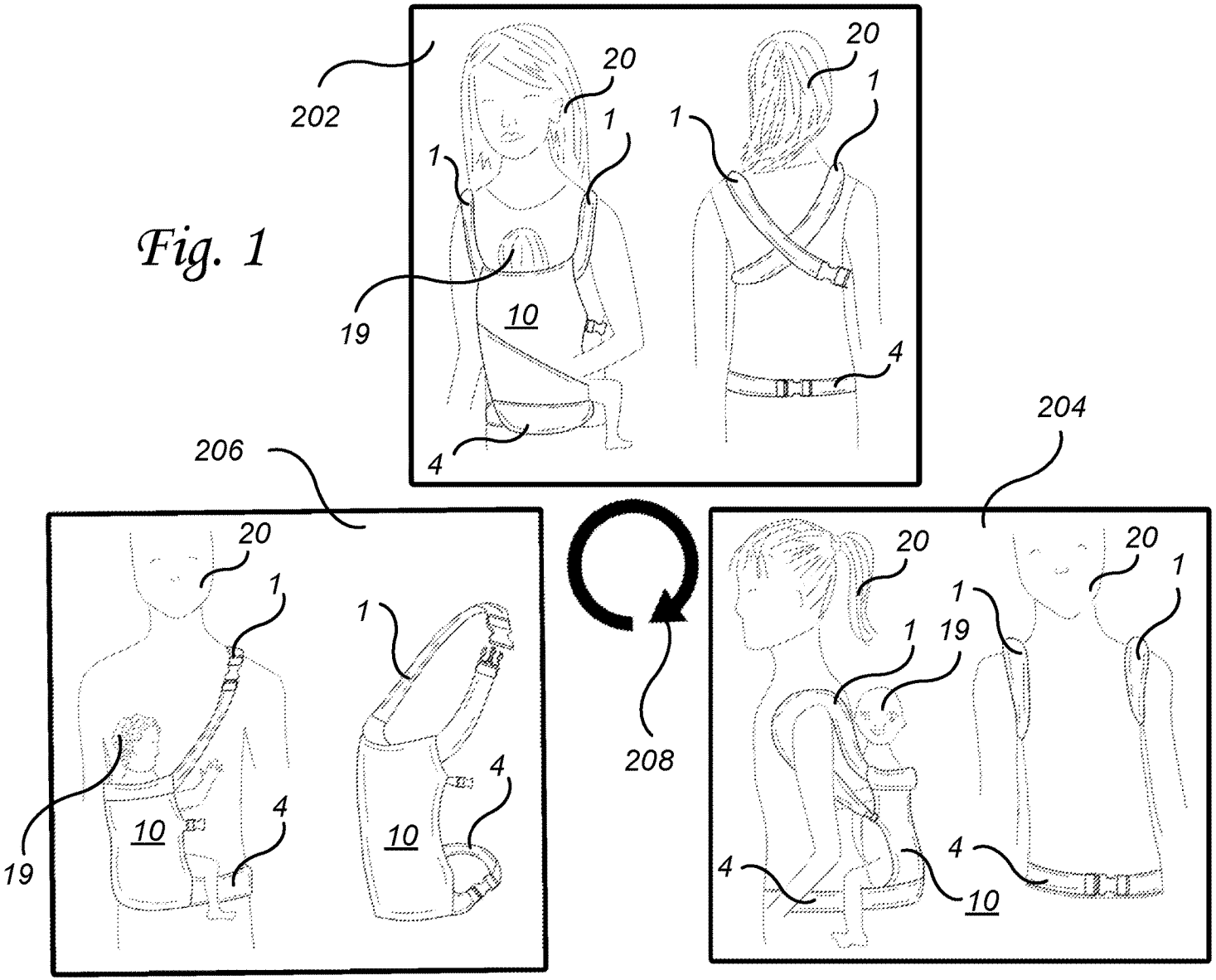
FIG. 1 illustrates examples of a three-position child carrier transitioning between a front-carry position, a back-carry position, and a hip-carry position.

Turning now to the drawings in greater detail, it will be seen that in FIG. 1 there are illustrated examples of the three-position child carrier 100 transitioning 208 between a front-carry position 202, a back-carry position 204, and a hip-carry position 206. In an exemplary embodiment, the three-position child carrier 100 transitions 208 to a front-carry position 202 by interconnecting the shoulder strap 1 with the body portion 10 in a crisscross pattern across the back of the wearer 20 for carrying a child 19.

For disclosure purposes, the wearer 20 can also be referred to as the person 20, the user 20, or parent 20, mom or mother 20, consumer 20, or other suitable terms for the person wearing the three-position child carrier 100 of the present invention. Child 19 can be referred to as a baby 19, an infant 19, a kid 19, or other suitable terms for the child that is being carried inside the three-position child carrier 100 of the present invention.

In another exemplary embodiment, the three-position child carrier 100 transitions 208 to a back-carry position 204 by interconnecting each end of the shoulder strap 1 over each shoulder of the wearer 20 with the body portion 10 for carrying a child 19.

In another exemplary embodiment, the three-position child carrier 100 transitions to a hip-carry position 206 by interconnecting the shoulder strap 1 with itself over one shoulder of the wearer 20 for carrying a child 19.

In each exemplary embodiment, in each of the carry positions, a waist strap 4 interconnects around the waist of the wearer 20.

Figure 2:
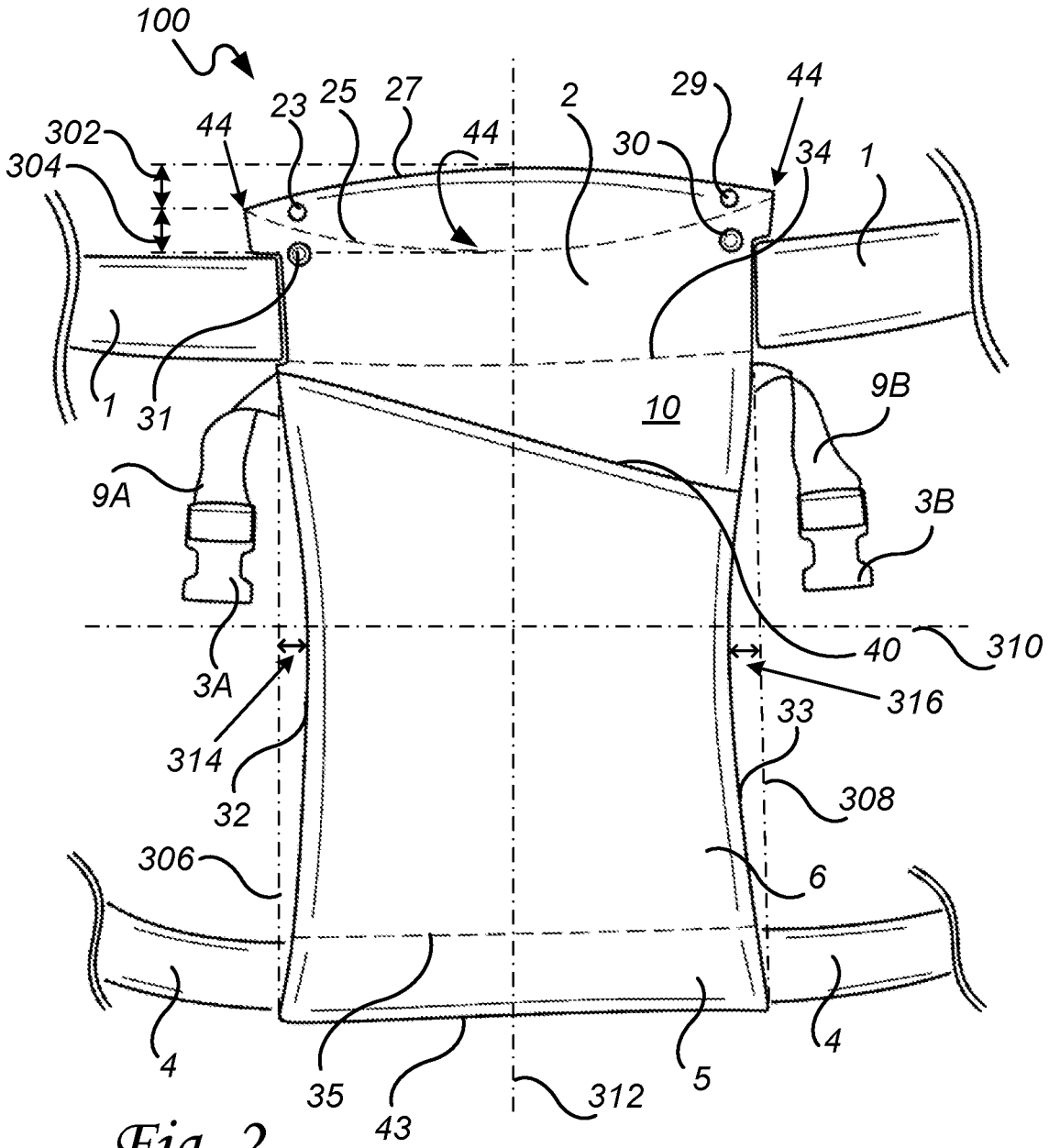
FIG. 2 illustrates one example of the body portion of the three-position child carrier.

Referring to FIG. 2, there is illustrated one example of the body portion 10 of the three-position child carrier 100. In an exemplary embodiment, the material, the shape, structure, and features of the body portion 10 can be manufactured from a soft cloth durable fabric material, foam, rubber, films, plastic, polymer, water-resistant materials, heat-resistant materials, wind-resistant, fire-resistant materials, combinations thereof, or other suitable materials. The texture, shape, style, and other design elements of the body portion 10 can be tailored, as may be required and/or desired in a particular embodiment.

The body portion 10 comprises an upper channel 2 on the upper portion of the body portion 10 and a lower channel 5 on the lower portion of the body portion 10. The upper channel 2 is configured to allow a shoulder strap 1 to pass through the upper channel 2 and secure the top portion of the body portion 10. The upper channel 2 can be formed by stitching two or more layers of material together along the fold stitching 25 and the upper channel stitching 34 leaving the channel formed therebetween unobstructed and sized to allow the shoulder strap 1 to pass through the upper channel 2.

The lower channel 5 is configured to allow a waist strap 4 to pass through the lower channel 5 and secure the lower portion of the body portion 10. The lower channel 5 can be formed by folding the material creating the bottom edge 43 or formed by stitching two or more layers of material together along the bottom edge 43 and the bottom channel stitching 35 leaving the channel formed therebetween unobstructed and sized to allow the waist strap 4 to pass through the lower channel 5.

There may exist on the body portion 10 multiple lower channels 5 which will aid in adjustment for varying child 19 heights. In the alternative, once inserted the waist strap 4 can be rotated or otherwise flipped to fold up or let down the lower part of the body portion 10 effectively changing the length and correct sizing the body portion 10 for the child 19 being carried.

In an exemplary embodiment, body portion 10 is made of a material that is flexible. Such a flexible material can be fabric, foam, rubber, films, plastic, polymer, or other suitable flexible material, as may be required and/or desired in a particular embodiment.

The body portion 10 comprises a front surface, a back surface, a top edge 27, a left edge 32, a right edge 33, a fold stitching 25, an upper channel stitching 34, a bottom channel stitching 35, and a bottom edge 43.

In an exemplary embodiment, the upper channel 2 is formed by folding the material creating the top edge 27, or adding a second piece of material and stitching along the fold stitching 25 and the upper channel stitching 34. The lower channel 5 is formed by folding the material creating the bottom edge 43, or adding a second piece of material and stitching along the bottom channel stitching 35 and selectively stitching along the bottom edge 43 if necessary.

Shoulder strap buckle receivers 3A-B, each has a short tether strap 9A-B that is positioned on opposing sides and secured to the body panel 10. In an exemplary embodiment, shoulder strap buckle receivers 3A-B with tether straps 9A-B can be positioned on opposing sides of the body portion 10 located in the upper half of the body panel 10 ideally just below the fold stitching 25. In a plurality of exemplary embodiments, the tether straps 9A-B can range in length from several inches to significantly less than an inch where the buckle receivers 3A-B are as close as possible to being directly connected to the body portion 10. The flexibility in the length of tether straps 9A-B in different embodiments allows for accommodating different body portion 10 shape designs and other body portion 10 design elements, different body types and sizes of wearer 20, and different body types and sizes of child 19.

In an exemplary embodiment, a first tether strap 9A comprises a first shoulder strap buckle receiver 3A on one end, the first tether strap 9A is fastened at the other end to the body portion 10 proximate the left edge 32 below the fold stitching 25. A second tether strap 9B comprises a second shoulder strap buckle receiver 3B on one end, the second tether strap 9B is fastened at the other end to the body portion 10 proximate the right edge 33 below the fold stitching 25. In a plurality of exemplary embodiments, the tether straps 9A-B can range in length from several inches to significantly less than an inch where the buckle receivers 3A-B are almost directly connected to the body portion 10.

Each of the shoulder strap buckle receivers 3A-B fasten in a secure but removable manner to each end of the shoulder strap 1 in the front-carry position 202 and the back-carry position 204. The shoulder strap 1 having at least a first end 36, a second end 37, a shoulder strap buckle 14A is secured to the first end 36, and a shoulder strap buckle 14B is secured to the second end 37. A buckle receiver 15 is attached between the first buckle 14A and the second buckle 14B.

Figure 5A:
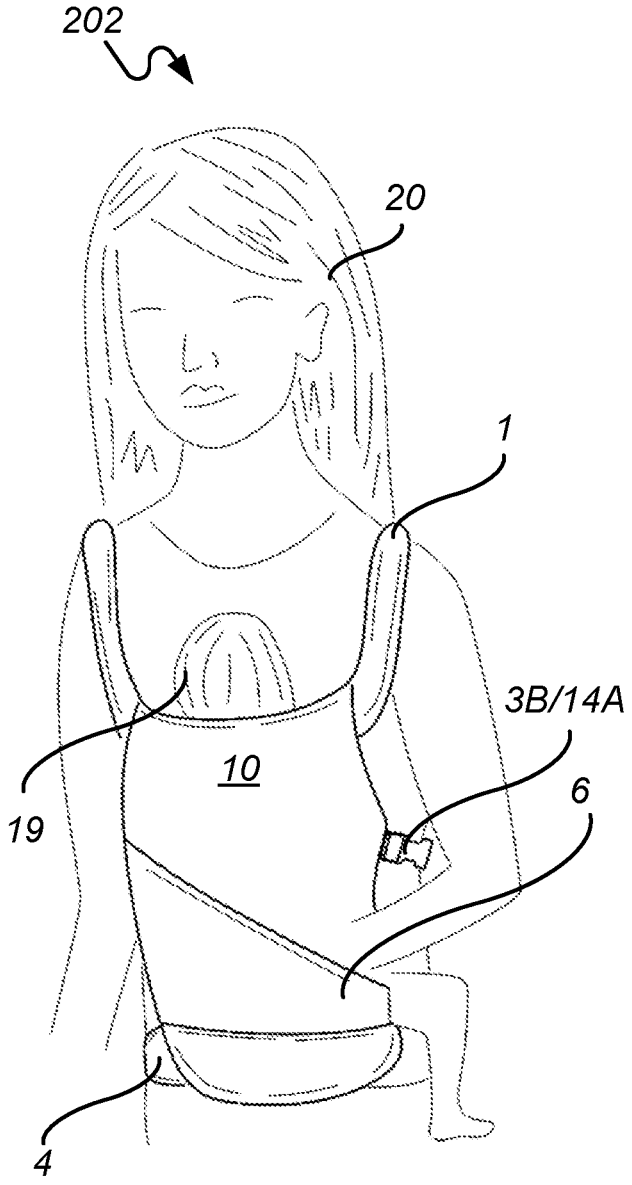
FIGS. 5A and 5B illustrate one example of the front-carry position configuration.
Figure 5B:
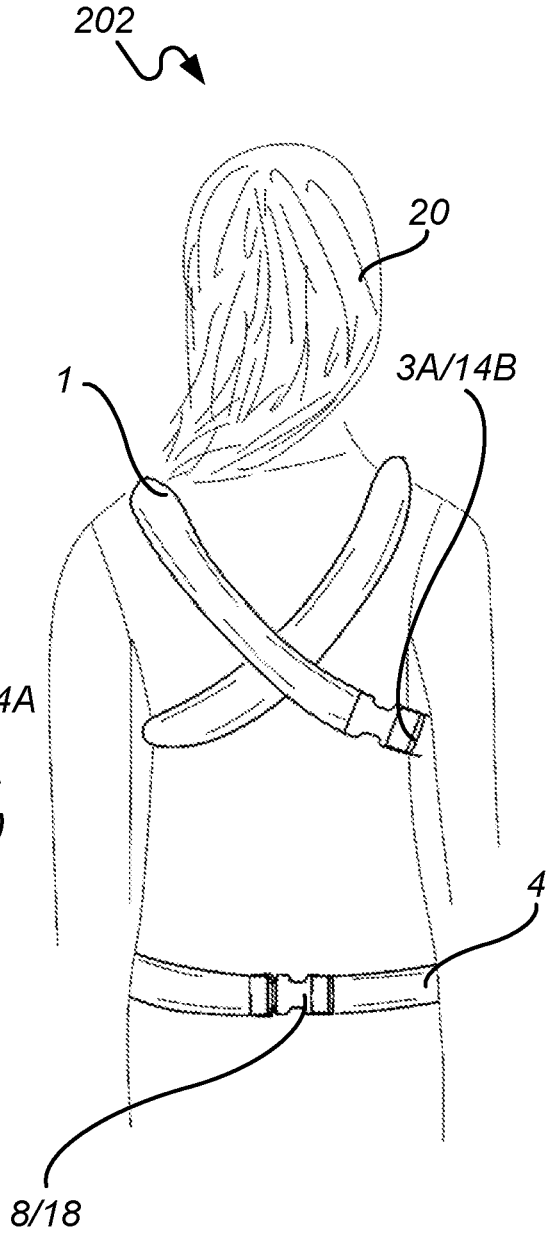
Figure 6A:
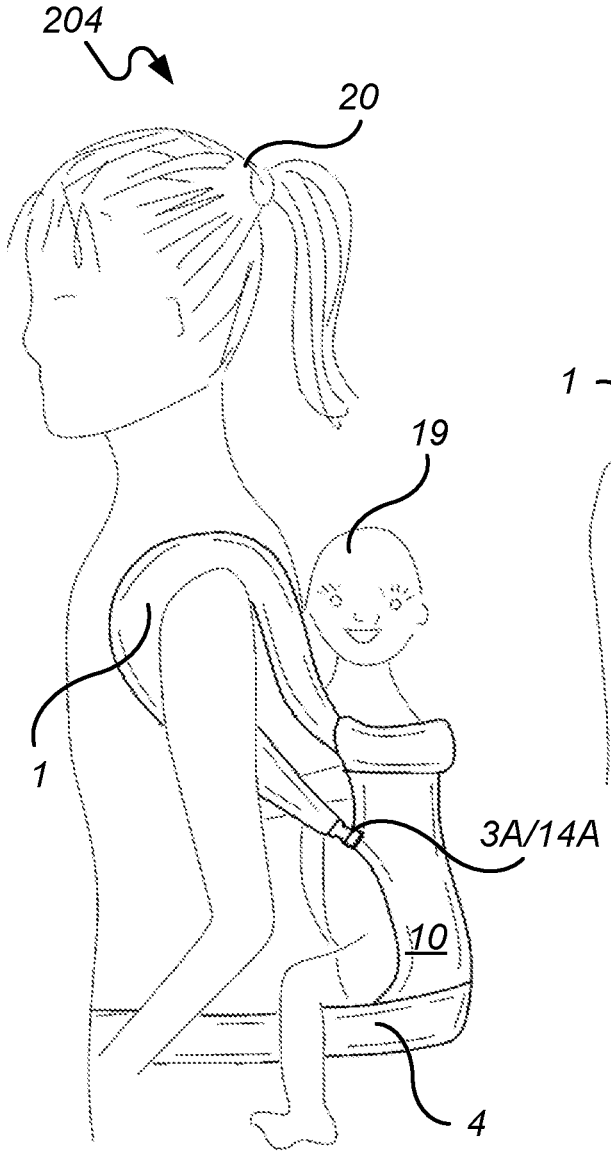
FIGS. 6A and 6B illustrate one example of the back-carry position configuration.
Figure 6B:
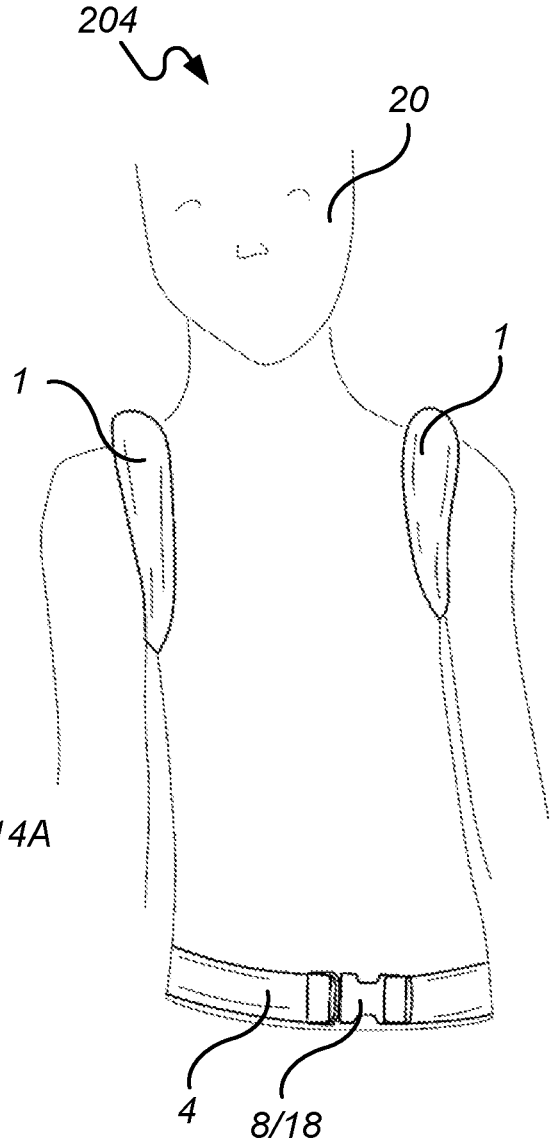
Figure 7A:
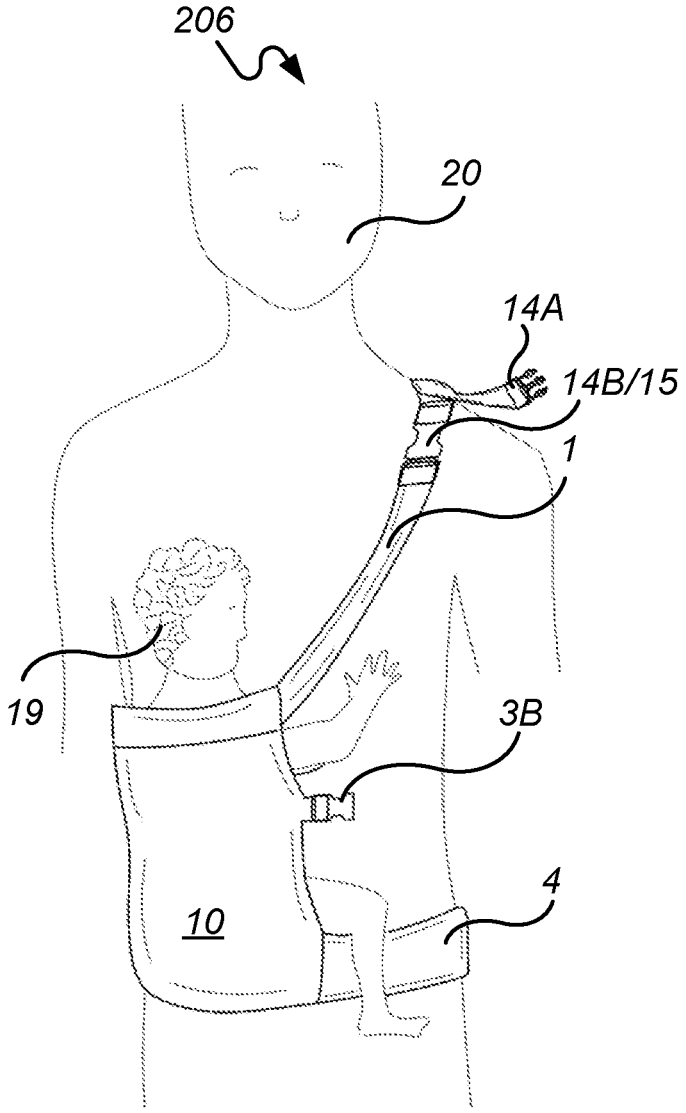
FIGS. 7A and 7B illustrates one example of the hip-carry position configuration.
Figure 7B:
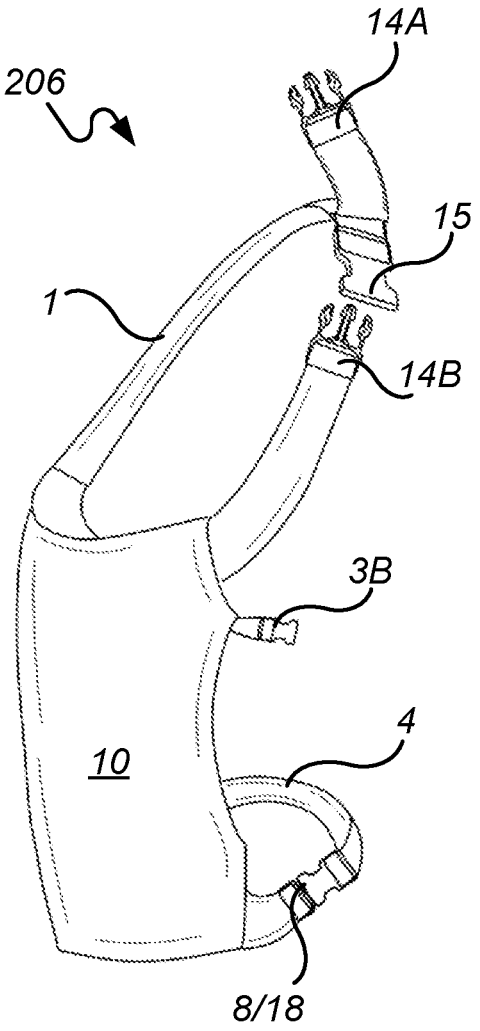

In an exemplary embodiment, the body portion 10 and shoulder strap 1 can be configured for a front-carry position 202 as illustrated in at least FIGS. 5A and 5B, a back-carry position 204 as illustrated in at least FIGS. 6A and 6B, or a hip-carry position 206 as illustrated in at least FIGS. 7A and 7B.

In this regard, the three-position child carrier 100 transitions to a front-carry position 202 by interconnecting the first shoulder strap buckle receiver 3A and the second buckle 14B and interconnecting the second shoulder strap buckle receiver 3B and the first buckle 14A in a crisscross pattern across the back of the wearer 20 for carrying a child 19.

The three-position child carrier 100 transitions to a back-carry position 204 by interconnecting the first shoulder strap buckle receiver 3A and the first buckle 14A, and interconnecting the second shoulder strap buckle receiver 3B and the second buckle 14B over each shoulder of the wearer 20 for carrying a child 19.

The three-position child carrier 100 transitions to a hip-carry position 206 by interconnecting the buckle receiver 15 and the second buckle 14B over one shoulder of the wearer 20 for carrying a child 19.

In an exemplary embodiment, a first fastener pair 29 and 30 are located on each side on the fold stitch 25 proximate the top edge 27 and right edge 33. A second fastener pair 23 and 31 are located on each side on the fold stitch 25 proximate the top edge 27 and left edge 32. The top edge 27 folds along the fold stitching 25 forming a folded edge along the fold stitching 25 and is secured by the first fastener pair 29 and 30 and the second fastener pair 23 and 31. The first and second fastener pairs can be magnets having opposing magnet polarities, snap or button type fasteners that interconnect, hook and loop fasteners, or other types or kinds of fastener pairs, as may be required and/or desired in a particular embodiment.

An advantage, in the present invention, is that the top edge 27 can be extended as illustrated in FIG. 2 providing additional head and neck support for child 19 when the fastener pairs 23 and 31, and 29 and 30 are unsnapped or otherwise unfastened. In the alternative, when the top edge 27 is folded 44 at the fold stitching 25 and fastener pairs 23 and 31, and 29 and 30 are snapped or otherwise fastened, the body portion is shorter at the top and the child 19 has more head and neck mobility to rotate and look around.

In an exemplary embodiment, there is a pocket 6 that can be contoured cut along the top edge 40. Such contoured cut can be a slope, a diagonal, a curve, or other cut shape or design, as may be required and/or desired in a particular embodiment across the front of the body portion 10. Pocket 6 allows the wearer 20 to carry items placed into pocket 6 securely. The size, shape, and location of pocket 6 may be changed to accommodate various materials of the body portion 10. Pocket 6 can comprise a zipper, or other fasteners at the top edge so that pocket 6 can be opened when access is needed and then securely closed.

In another exemplary embodiment, the pocket is positioned on the front surface of body 10 and fastened to the left edge 32, the right edge 33, and the bottom edge 5. Pocket 6 further comprises the contoured top edge 40.

In an exemplary embodiment, to provide the best fit and comfort options for both the wearer 20 and the child 19, the body portion 10 can be cut or otherwise contoured. For disclosure purposes, the cuts and contours are referenced in FIG. 2 to a vertical reference line 312 and a horizontal reference line 310. Concave curvatures indicate that the curve is cut inward towards the reference line and convex curvatures indicate that the curve is cut outward away from the reference line.

In an exemplary embodiment, the top edge 27 can be cut in a convex curve shape with respect to the horizontal reference line 310, extending away from the horizontal reference line 310. Such top edge 27 convex curve shape maximum can be in the range 302 of substantially straight to 5 inches and preferably in the range of 0.5 inch to 3 inches.

The left edge 32 and the right edge 33 are cut in a concave curved shape with respect to the vertical reference line 312, extending towards the vertical reference line 312. Left vertical reference line 306 illustrates the inward contoured left edge 32. Such left edge 32 concave curve shape maximum can be in the range 314 of substantially straight to 5 inches and preferably in the range of 0.5 inch to 3 inches. Right vertical reference line 308 illustrates the inward contoured right edge 33. Such right edge 33 concave curve shape maximum can be in the range 316 of substantially straight to 5 inches and preferably in the range of 0.5 inch to 3 inches. In an exemplary embodiment, such contouring of the left edge 32 and right edge 33 can provide better fit and function of the body portion 10, as well as increase comfort for child 19. In design, the contoured edges better follow the body style contours and curves of child 19 promoting better fit and comfort and reduce excess body portion 10 material that can lead to a poor or less snug fit for child 19.

The fold stitching 25 is stitched in a concave curved shape with respect to a horizontal reference line 310. Such fold stitching 25 concave curve shape maximum can be in the range 304, measured from where the top edge 27 meets the left edge 32 and the right edge 33, of substantially straight to 5 inches and preferably in the range of 1 inch to 3 inches.

The folded edge 44 formed along the fold stitching 25 when the top edge 27 is folded down is a concave curved shape with respect to a horizontal reference line 310. Such fold edge 44 is concavely curved in shape, that follows the fold stitching 25, maximum can be in the range 304 of substantially straight to 5 inches and preferably in the range of 0.5 inch to 3 inches. The folded edge 44 is only formed when the top edge 27 is folded down across the fold stitching 25.

Figure 3:
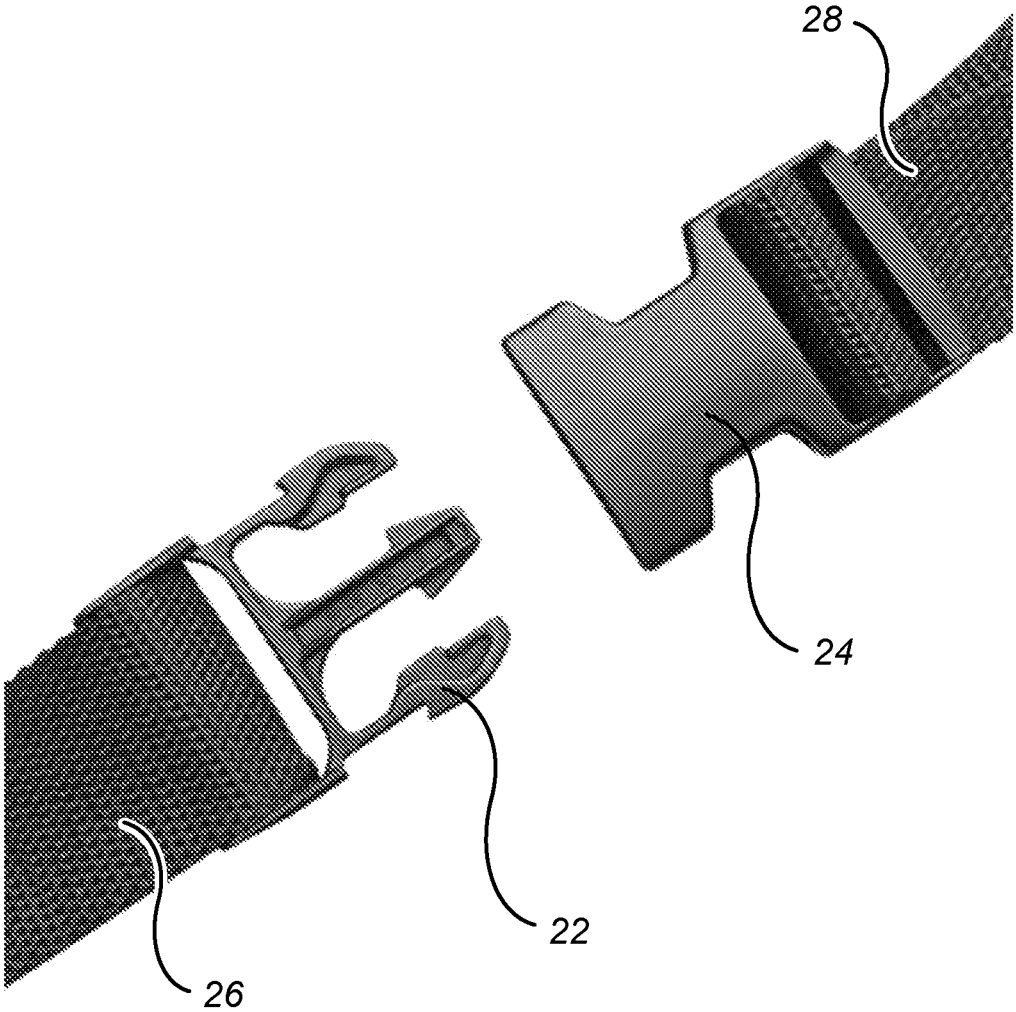
FIG. 3 illustrates one example of a strap, buckle, and buckle receiver.

Referring to FIG. 3, there is illustrated one example of a strap, buckle, and buckle receiver. In the present invention, "buckle", "buckle-style", and "buckle receiver" are terms used to describe the interlocking nature of these types of fasteners. In operation, the buckle slides into the buckle receiver clicking and locking in place. A wearer can press the sides of the buckle which are exposed at the edges of the buckle receiver and slide the buckle out of the buckle receiver to release. The terms buckle and buckle receiver are not intended to be limitations, in the present invention, in that buckles and buckle receivers can be interchanged and still perform the same function. For example, the first shoulder strap buckle receiver 3A, the second shoulder strap buckle receiver 3B, and the buckle receiver 15 are interchangeable for buckles, and the first buckle 14A and the second buckle 14B are interchangeable for buckle receivers such that the shoulder strap 1 interconnects and secures the body portion 10 for the front-carry position 202 and back-carry position 206 and the shoulder strap 1 interconnects with itself forming a continuous loop in the hip-carry position 206.

In an exemplary embodiment, as an example of how the straps, buckles, and buckle receivers of the present invention can be configured, buckle 22 can be interconnected with a strap 26, and buckle receiver 24 can be interconnected with a strap 28. Strap 26 can be affixed in position to the buckle 22 and strap 28 can be woven through one end of the buckle receiver 24 as to be slidably adjustable along a length of strap 28 allowing the connection portion of strap 28 to be lengthened or shortened. The converse can also be configured where the buckle receiver 24 can be affixed to strap 28 and the buckle can have strap 26 woven through one end as to be slidably adjustable along the length of strap 26 to shorten or lengthen the strap connection. These alternative configurations can be mixed and matched, in the present invention, to make it easy for the wearer 20 to interconnect the buckles and buckles receivers and adjust the straps for a secure fit for the wearer 20 and child 19, as may be required and/or desired in a particular embodiment.

Also, in a plurality of exemplary embodiments, the types and kinds of buckle 22 and buckle receiver 24 are examples and other sizes, configurations, types, or kinds of buckles and buckle receivers can be used in the present invention. Such buckle and buckle receivers can be the interlocking type as illustrated in FIG. 3, carabiners, hook and loop type fasteners, snap-type fasteners, or other types and/or kinds of buckles and buckle receivers, as may be required and/or desired in a particular embodiment. Such buckle and buckle receivers can be made of plastic, metal, or other suitable materials, as may be required and/or desired in a particular embodiment. The straps 26 and 28, webbing strap 13, and waist webbing strap 17 can be made from a cord, rope, polymer, fabric, formed with woven or webbed construction techniques, or made from other suitable materials and formed with other suitable construction techniques, as may be required and/or desired in a particular embodiment.

Referring to FIG. 4A there is illustrated one example of reference 'A', a top view of the shoulder strap 1, and reference 'B', a side view of the shoulder strap 1. In an exemplary embodiment, the shape, structure, foam padding, and features of the shoulder strap 1 can be manufactured from a combination of durable fabric material, woven strap or cord materials, clips or fasteners, foam, rubber, or other suitable materials, as may be required and/or desired in a particular embodiment. Also, the texture, shape, style, and other design elements can be tailored, as may be required and/or desired in a particular embodiment.

The shoulder strap 1 can comprise a shoulder strap cover 11, a webbing strap 13, shoulder strap padding 12, at least two of the buckles 14A-B, and at least one buckle receiver 15. The shoulder strap cover 11 can be fabric, film, plastic, foam, rubber, polymer, water-resistant materials, heat-resistant materials, wind-resistant, fire-resistant materials, or other suitable material. The shoulder strap 1 has at least a first end 36, a second end 37, a shoulder strap buckle 14A is secured to the first end 36, and a shoulder strap buckle 14B is secured to the second end 37. A buckle receiver 15 is attached between the first buckle 14A and the second buckle 14B. When wearing the shoulder strap 1, the wearer 20 can position the shoulder strap pad 12 between the wearer's 20 body/shoulder and the webbing strap 13 such that the webbing strap 13 tightens or pulls underweight into the shoulder strap padding 12 and not into the wearer's 20 body/shoulder making wearing the three-position child carrier 100 more comfortable for the wearer 20.

In an exemplary embodiment, shoulder strap 1 can be padded with structured foam illustrated as shoulder strap padding 12, with the webbing strap 13 running along the top length of the shoulder strap 1. The webbing strap 13 having a first end 36 and a second end 37. Attached to the first end is one of the buckles 14A and attached to the second end is a buckle 14B. Shoulder strap cover 11 covers the shoulder strap padding 12 leaving the webbing strap 13 on top, the buckles 14A-B and buckle receiver 15 accessible to the wearer 20. The buckle receiver 15 allows the shoulder strap 1 to connect to itself for hip-carry position 206, as better illustrated in at least FIGS. 7A and 7B.

In an exemplary embodiment, at least some of the buckles 14A or 14B, the buckle receiver 15, or the buckle receivers 3A or 3B are securely slidable and repositionable along the shoulder webbing strap 13 or the tether straps 9A-9B so that the shoulder strap 1 length can be adjusted to create a secure and safe fit for the wearer 20 and the child 19.

The shoulder strap shoulder padding 12 with strap cover 11 combination form flaps 2A-B at each end of the shoulder strap 1. The flaps 2A and 2B are designed to rest beneath the buckle 14A-B and/or buckle receiver 15 between the webbing strap 13 and the wearer's 20 shoulders and/or body in most of the different three-position child carrier wearable positions 202, 204, and 206.

In an exemplary embodiment, the shoulder strap 1 can be manufactured as a single assembly that passes through the upper channel 2 on the upper portion of the body portion 10 and is then used to secure the three-position child carrier 100 around the wearer's 20 shoulders and child 19.

Referring to FIG. 4B there is illustrated one example of reference 'A', a top view of the waist strap 4, and reference 'B', a side view of the waist strap 4. In an exemplary embodiment, the shape, structure, foam padding, and features of the waist strap 4 can be manufactured from a combination of durable fabric materials, woven strap or cord materials, clips or fasteners, foam, rubber, plastic, polymer, or other suitable materials, as may be required and/or desired in a particular embodiment. Also, the texture, shape, style, and other design elements can be tailored, as may be required and/or desired in a particular embodiment.

The waist strap 4 comprises a waist strap cover 16, a waist strap pad 41, a waist webbing strap 17 having a first waist webbing strap end 38 and a second waist webbing strap end 39, a waist buckle 8 is secured to the first waist webbing strap end 38, a waist buckle receiver 18 is secured to the second waist webbing strap end 39, and at least one of a waist adjustment band 7. The waist adjustment bands 7 are repositionable along the waist webbing strap 17 to manage the loose portions of the waist webbing strap 17 to prevent tangles or binding of the waist webbing strap 17 at the waist buckle 8 and/or waist buckle receiver 18. The waist adjustment band 7 can be an elastic band or other types of kinds of bands, as may be required and/or desired in a particular embodiment. Additionally, the wearer 20 can manage the loose ends of the waist webbing strap 39 by tucking them into the lower channel 5. The waist strap cover 16 can be fabric, film, plastic, foam, rubber, polymer, water-resistant materials, heat-resistant materials, wind-resistant, fire-resistant materials, or other suitable material.

In an exemplary embodiment, the waist strap cover 16 can be a fabric or other suitable material wrapped around a piece of structured foam illustrated as waist strap pad 41, to provide support to the back of the wearer 20. Waist webbing strap 17 can comprise a waist buckle 8 at the first waist webbing strap end 38 and a waist buckle receiver 18 at the second waist webbing strap end 39. Waist adjustment bands 7 are repositionable along the waist webbing strap 17 to manage the loose portions of the waist webbing strap 17 to prevent tangles or binding of the waist webbing strap 17 at the waist buckle 8 and/or waist buckle receiver 18.

In an exemplary embodiment, the waist strap comprises a waist strap cover 16 and a waist strap pad 41 having a waist strap pad top surface and a waist strap pad bottom surface. The waist strap cover 16 covers the waist strap pad 41. The waist webbing strap 17 attaches to the top of the combined waist strap pad 41 and waist strap cover 16 leaving the waist webbing strap 17, the waist buckle 8, and the waist buckle receiver 18 accessible to the wearer 20. The waist strap pad 41 with waist strap cover 16 combination form waist strap flaps 42A-B at each end of the waist strap 4 that rests beneath the waist buckle 8, and the waist buckle receiver 18 between the waist strap webbing strap 17 and the the wearer's 20 waist when interlocked around the waist of the wearer 20. When wearing the waist strap 1, the wearer 20 can position the waist strap pad 41 between the wearer's 20 waist and/or body and the waist webbing strap 17 such that the waist webbing strap 17 tightens or pulls underweight into the waist strap padding 41 and not into the wearer's 20 body making wearing the three-position child carrier 100 more comfortable for the wearer 20.

Referring to FIGS. 5A and 5B, there is illustrated one example of the front-carry position 202 configuration. In an exemplary embodiment, FIG. 5A illustrates a front view of a wearer 20 carrying a child 19 in the front-carry position. FIG. 5B illustrates a back view of a wearer 20 carrying a child 19 in the front-carry position.

Child 19 is shown in the front-carry position 202 in which child 19 faces inward towards the wearer 20. In this configuration, body portion 10 is secured at the top portion by the shoulder strap 1. The buckle receiver 3B securely clips with the shoulder strap 1, buckle 14A. The shoulder strap 1 runs through the upper channel 2, then crosses over the upper back of wearer 20 in an "X" or crisscross pattern, attaching buckle 14B to the opposite side corresponding to buckle receiver 3A (in the upper portion of the body portion 10). FIG. 2 illustrates the location of the buckle receivers 3A-B and FIG. 4A illustrated the buckle 14A-B locations.

This configuration offers additional support and reduces stresses placed on the wearer's 20 shoulders. The waist strap 4 secures the lower portion of the body portion 10 by interconnecting the waist buckle 8 and the waist buckle receiver 18.

In an exemplary embodiment, the lower part of the body portion 10 can be adjusted to keep the infant's legs in an M-position, currently considered to be the healthiest formation for hip development. To adjust the size of the body portion 10 for shorter infants 19, the waist strap 17 can be folded or flipped over the body portion 10, or secured through a second, higher channel, effectively shortening or lengthening the body portion 10 as need to fit the child 19.

The term "M-position", in the present invention, is intended to mean the natural clinging position for child 19. It is also known as the "Spread-Squat", or "Jockey Position". This position is recommended as a healthy habit with the child's 19 thighs spread around the wearer's 20 torso and the child's 19 hips are bent so that the knees are in the range of 45 degrees, the hip to thigh bend is in the range of 45 degrees, and the spread of the thighs is in the range of 90 degrees.

In an exemplary embodiment, the three-position child carrier 100 transitions to a front-carry position 202 by interconnecting the first shoulder strap buckle receiver 3A and the second buckle 14B and interconnecting the second shoulder strap buckle receiver 3B and the first buckle 14A in a crisscross pattern across the back of the wearer 20 for carrying the child 19.

Referring to FIGS. 6A and 6B, there is illustrated one example of a back-carry position 204 configuration. In an exemplary embodiment, FIG. 6A illustrates a side view of a wearer 20 carrying a child 19 and FIG. 6B illustrates a front view of a wearer 20 carrying a child 19.

In an exemplary embodiment, shoulder strap 1 goes over the wearer's 20 shoulders and connects buckle 14A to the same side corresponding to buckle receiver 3A and buckle 14B to the same side corresponding to buckle receiver 3B to create carrying support much like the straps of a backpack. The waist strap 4 secures the lower portion of the body portion 10 by interconnecting the waist buckle 8 and the waist buckle receiver 18. FIG. 2 illustrates the location of the buckle receivers 3A-B and FIG. 4A illustrates the buckles 14A-B locations.

In an exemplary embodiment, the lower part of the body portion 10 can be adjusted to keep the child's legs in an M-position around the wearer's 20 such that the child's 19 legs hangover/around the wearer's torso and hips. To adjust the size of the body portion 10 for a shorter child 19, the waist strap 17 while in the lower channel 5 can be folded or flipped over the body portion 10, or secured through a second, higher lower channel when there are multiple lower channels to choose from to effectively shortening, lengthening, or otherwise adjust the body portion 10 as needed to fit the child 19.

In an exemplary embodiment, the three-position child carrier 100 transitions to a back-carry position 204 by interconnecting the first shoulder strap buckle receiver 3A and the first buckle 14A and interconnecting the second shoulder strap buckle receiver 3B and the second buckle 14B over each shoulder of the wearer to carry child 19.

Referring to FIGS. 7A and 7B there is illustrated one example of the hip-carry position 206 configuration. In an exemplary embodiment, FIG. 7A illustrates a front view of the hip-carry position 206, and FIG. 7B illustrates a side view of the three-position child carrier configured in the hip-carry position 206.

In the hip carrier position 206, the three-position child carrier 100 is secured with the shoulder strap 1 in a configuration forming a circle around the wearer's 20 shoulder by connecting to itself by way of interconnecting buckle 14B and the buckle receiver 15 to create a single looped shoulder strap 1. The shoulder strap receivers 3A and 3B are left unconnected in the hip-carry position 206. The waist strap 4 secures the lower portion of the body portion 10 by interconnecting the waist buckle 8 and the waist buckle receiver 18 around the waist of the wearer 20.

In an exemplary embodiment, the three-position child carrier 100 transitions to a hip-carry position 206 by interconnecting the shoulder strap 1 to itself. In this regard, the buckle receiver 15 and the second buckle 14B are interconnected forming a continuous shoulder strap 1 loop over one shoulder of the wearer 20.

Figure 8:
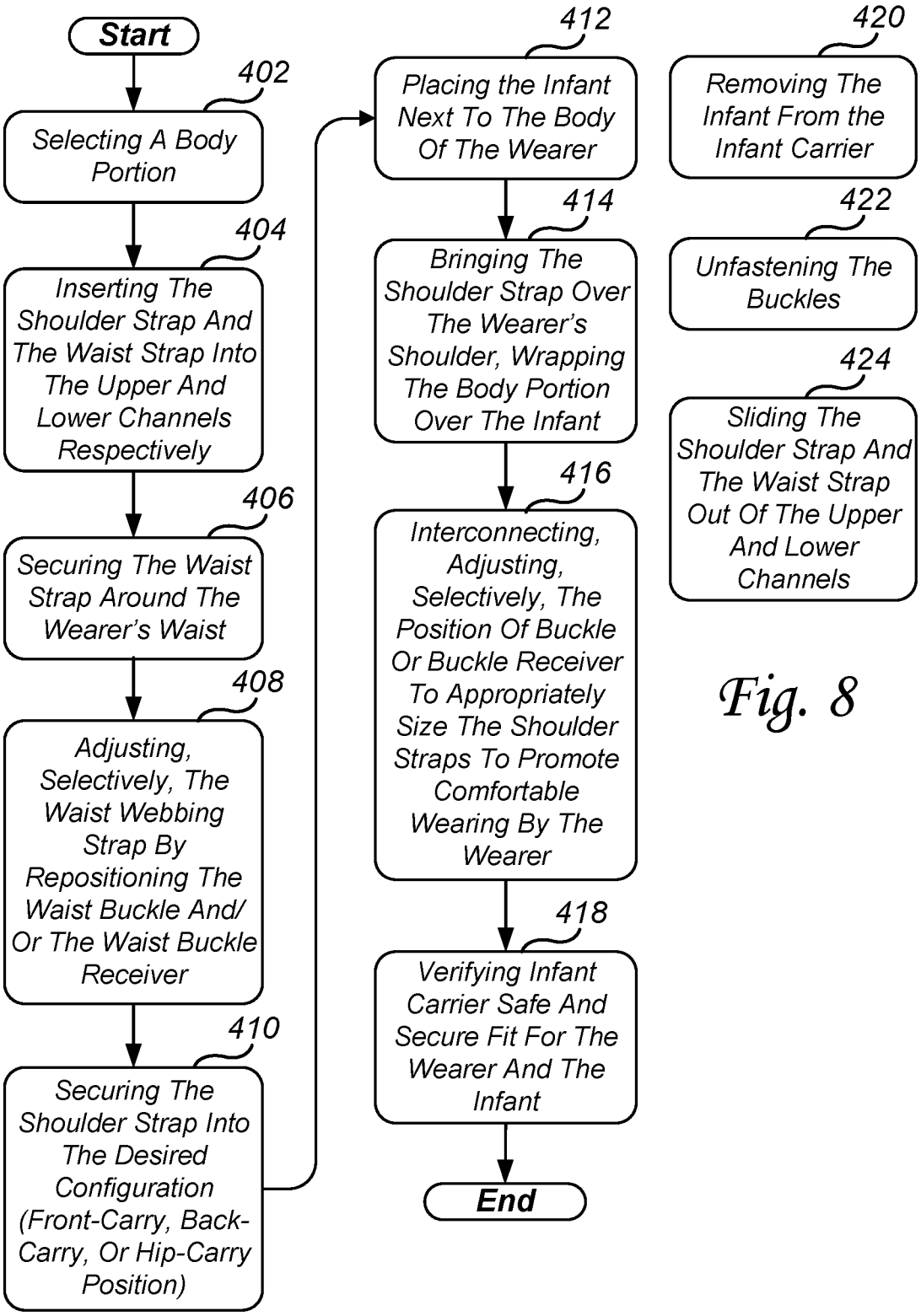
FIG. 8 illustrates one example of a method of adjustably wearing a three-position child carrier.

Referring to FIG. 8 there is illustrated one example of a method of adjustably wearing a three-position child carrier 100. In an exemplary embodiment, the method begins in step 402 where a body portion 10 can be selected. Such body portion 10 selection can include ensuring the correct body portion 10 fit for the child 19. One method of checking the correct body portion 10 fit is to layout the body portion 10 and lay the child 19 down on the body portion 10 to verify that the top channel 5 aligns with the child's 19 shoulders and the bottom channel 5 aligns right below the child's 19 hips so that the waist band 4 will rest under the child's 19 buttocks while riding in the three-part child carrier 100. Other body portion 10 selection criteria can include colors, styles, body portion 10 materials, fashion and design preferences, weather, temperature, and other selection criteria, as may be required and/or desired in a particular embodiment.

In step 404, the shoulder strap 1 and waist strap 4 are inserted into the upper channel 2 and lower channel 5 respectively. The waist strap 4 can then be secured around the wearer's 20 waist in step 406 and selectively adjusted for fit by way of repositioning along the waist webbing strap 17 the waist buckle 8 and/or the waist buckle receiver 18, in step 408.

In step 410, the shoulder strap 1 is configured for the desired carry position such as front-carry position 202 as illustrated in FIGS. 5A and 5B, back-carry position 204 as illustrated in FIGS. 6A and 6B, or hip-carry position 206 as illustrated in FIGS. 7A and 7B.

In step 412, child 19 is then positioned next to the wearer's 20 body and in step 414, shoulder strap 1 is brought over the wearer's 20 shoulders, wherein the body portion 10 wraps over the infant's 19 body. The buckle 14A-B, shoulder strap buckle receiver 3A-B, and/or the buckle receiver 15 are interconnected as required by the carry position 202, 204, or 206 selected and adjusted as required to promote comfortable wearing by the wearer 20 and child 19, in step 416.

In step 418, the correct safe and secure fit is verified for the wearer 20 and child 19. Such fit verification includes checking for proper fit by examining the child's 19 positionings including hips, legs, torso, arms, face, and head. This includes checking the hips for the M-position, ensuring legs and arms are free of pressure and restriction, the face is clear and the infant can breathe freely, and the head is close enough to the wearer's face to "kiss" in a front-carry position 202. The wearer 20 must also ensure the child 19 stays secure as the wearer 20 moves. The method is then exited.

Additional, exemplary embodiments that can be interchangeably used with the methods of the present invention include additional steps of removing child 19 from the three-position child carrier 100 in step 420, unfastening the buckles in step 422, and sliding the shoulder strap 1 and/or the waist strap 4 out of the upper channel 2 and lower channel 5 respectively in step 422.

Figure 9:
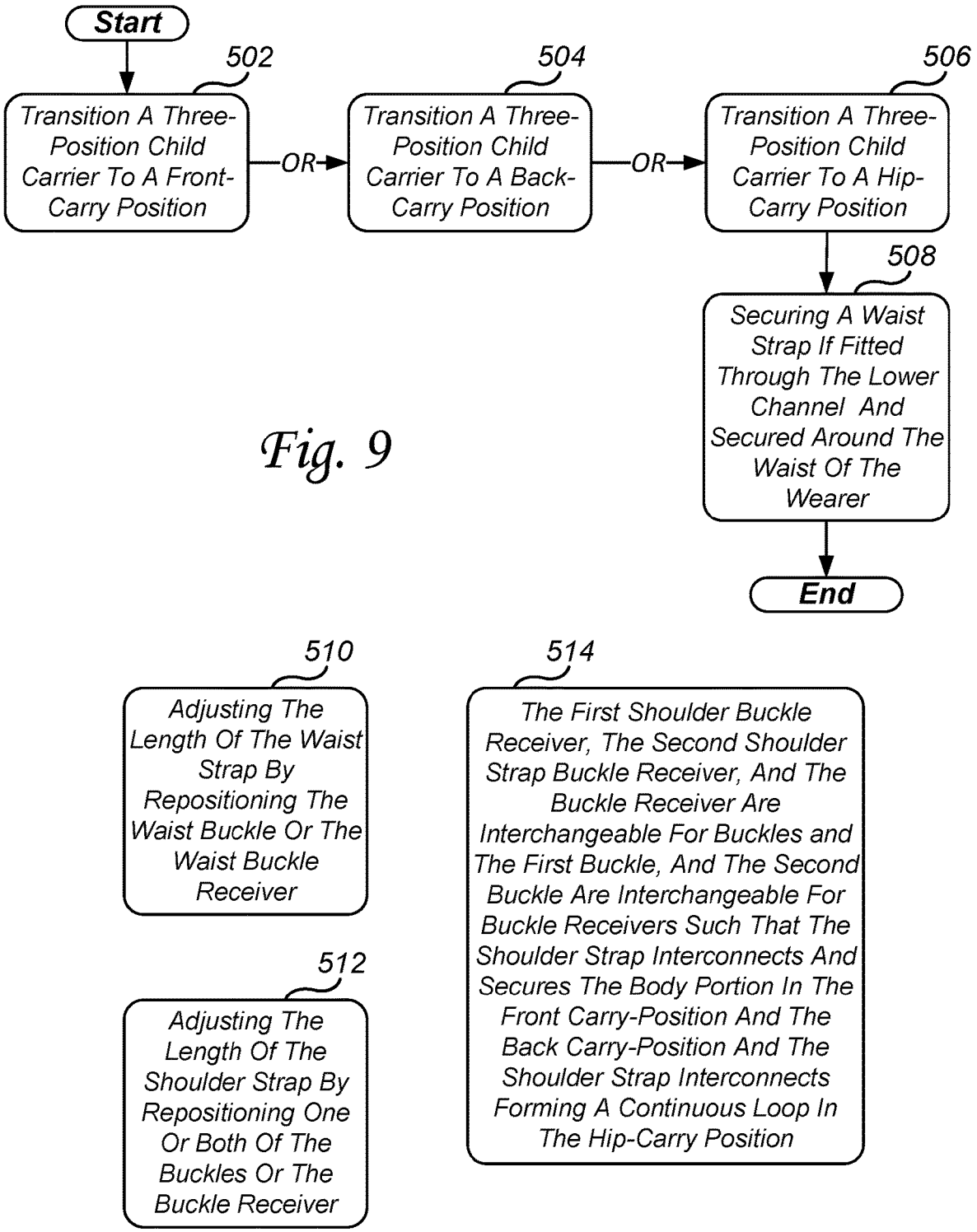
FIG. 9 illustrates one example of a method of using a three-position child carrier.

Referring to FIG. 9, there is illustrated one example of a method of using a three-position child carrier 100 to carry a child 19. In an exemplary embodiment, the method of using a three-position child carrier begins in step 502 where a three-position child carrier 100 transitions to a front-carry position 202 by interconnecting a first shoulder strap buckle receiver 3A and a second buckle 14B and interconnecting a second shoulder strap buckle receiver 3B and a first buckle 14A in a crisscross pattern across the back of the wearer 20.

A body portion 10 comprising a front surface, a back surface, a top edge, a left edge, a right edge, a fold stitching 25, an upper channel stitching 34, a bottom channel stitching 35, and a bottom edge 43.

A first tether strap 9A comprising a first shoulder strap buckle receiver 3A on one end, the first tether strap 9A is fastened to the body portion 10 proximate the left edge 32 below the fold stitching 25. A second tether strap 9B comprising a second shoulder strap buckle receiver 3B on one end, the second tether strap 9B is fastened to the body portion 10 proximate the right edge 33 below the fold stitching 25.

An upper channel is formed between the fold stitching 25 and the upper channel stitching 34. A lower channel is formed between the bottom edge 43 and the bottom channel stitching 35.

A shoulder strap 1 is fitted through the upper channel 2. Shoulder strap 1 comprising a webbing strap 13 having a first end, a second end. The first buckle 14A is secured to the first end, the second buckle 14B is secured to the second end, and a buckle receiver 15 is attached between the first buckle 14A and the second buckle 14B.

Or, in step 504, the three-position child carrier transitions to a back-carry position 204 by interconnecting the first shoulder strap buckle receiver 3A and the first buckle 14A, and interconnecting the second shoulder strap buckle receiver 3B and the second buckle 14B over each shoulder of the wearer 20.

Or, in step 506, the three-position child carrier transitions to a hip-carry position 206 by interconnecting the buckle receiver 15 and the second buckle 14B over one shoulder of the wearer 20.

And, in step 508, a waist strap 4 is secured around the waist of a wearer 20. The waist strap 4 is fitted through the lower channel 5. The waist strap 4 comprises a waist webbing strap 17 having a first waist webbing strap end and a second waist webbing strap end. A waist buckle 8 is secured to the first waist webbing strap end and a waist buckle receiver 18 is secured to the second waist webbing strap end. The waist buckle 8 and the waist buckle receiver 18 interconnect.

Additional, exemplary embodiments that can be interchangeably used with the methods of the present invention include additional steps in 510 of adjusting the length of the waist strap 4 by repositioning the waist buckle 8 or the waist buckle receiver 18. In step 512, adjusting the length of the shoulder strap 1 by repositioning the first buckle 14A and/or the second buckle 14B, or the buckle receiver 15. And, in step 514, wherein the first shoulder strap buckle receiver 3A, the second shoulder strap buckle receiver 3B, and the buckle receiver 15 are interchangeable for buckles, and the first buckle 14A and the second buckle 14B are interchangeable for buckle receivers such that the shoulder strap 1 interconnects and secures the body portion 10 in the front-carry position 202 and the back-carry position 204 and the shoulder strap 1 interconnects with itself forming a continuous loop in the hip-carry position 206.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment of the invention has been described, it will be understood that those skilled in the art, both now and in the future, may make various improvements and enhancements.

What is claimed is:

1. A three-position child carrier comprising:

a body portion comprising a front surface, a back surface, a top edge, a left edge, a right edge, a fold stitching, an upper channel stitching, a bottom channel stitching, and a bottom edge;

a first tether strap comprising a first shoulder strap buckle receiver on one end, the first tether strap is fastened to the body portion proximate the left edge below the fold stitching;

a second tether strap comprising a second shoulder strap buckle receiver on one end, the second tether strap is fastened to the body portion proximate the right edge below the fold stitching;

an upper channel is formed between the fold stitching and the upper channel stitching;

a lower channel is formed between the bottom edge and the bottom channel stitching;

a shoulder strap is fitted through the upper channel, the shoulder strap comprising a webbing strap having a first end, a second end, a first buckle is secured to the first end, a second buckle is secured to the second end, and a buckle receiver is attached between the first buckle and the second buckle; and a waist strap is fitted through the lower channel, the waist strap comprising a waist webbing strap having a first waist webbing strap end and a second waist webbing strap end, a waist buckle is secured to the first waist webbing strap end and a waist buckle receiver is secured to the second waist webbing strap end, the waist buckle and the waist buckle receiver interconnect around the waist of a wearer;

wherein the three-position child carrier transitions to a front-carry position by interconnecting the first shoulder strap buckle receiver and the second buckle, and interconnecting the second shoulder strap buckle receiver and the first buckle in a crisscross pattern across the back of the wearer, the buckle receiver is left unconnected in the front-carry position; or wherein the three-position child carrier transitions to a back-carry position by interconnecting the first shoulder strap buckle receiver and the first buckle, and interconnecting the second shoulder strap buckle receiver and the second buckle over each shoulder of the wearer, the buckle receiver is left unconnected in the back-carry position; or wherein the three-position child carrier transitions to a hip-carry position by interconnecting the buckle receiver and the second buckle over one shoulder of the wearer, each of the first buckle, the first shoulder strap buckle receiver, and the second shoulder strap buckle receiver is left unconnected in the hip-carry position.

2. The three-position child carrier in accordance with claim 1, further comprising:

a first fastener pair is located on each side of the fold stitch proximate to the top edge and right edge; and a second fastener pair is located on each side of the fold stitch proximate to the top edge and left edge, the top edge folds along the fold stitching forming a folded edge along the fold stitching and is secured by the first fastener pair and the second fastener pair.

3. The three-position child carrier in accordance with claim 1, further comprising:

a pocket is positioned on the front surface and fastened at the left edge, the right edge, and the bottom edge.

4. The three-position child carrier in accordance with claim 1, the shoulder strap further comprising:

a shoulder strap cover; and a shoulder strap pad having a shoulder strap pad top surface and a shoulder strap pad bottom surface, the shoulder strap cover covers the shoulder strap pad, the webbing strap attaches, on the outside of the shoulder strap cover, to the shoulder strap pad top surface, the first buckle, the second buckle, and the buckle receiver are accessible to the wearer, the shoulder strap pad and shoulder strap cover combination forms a flap at each end that rests beneath the first buckle, the second buckle, and the buckle receiver when interlocked with the second buckle.

5. The three-position child carrier in accordance with claim 1, the waist strap further comprising:

a waist strap cover; and a waist strap pad having a waist strap pad top surface and a waist strap pad bottom surface, the waist strap cover covers the waist strap pad, the waist webbing strap attaches, on the outside of the waist strap cover, to the waist strap pad top surface, the waist buckle and the waist buckle receiver are accessible to the wearer, the waist strap pad and the waist strap cover combination forms a waist strap flap at each end that rests beneath the waist buckle and the waist buckle receiver when interlocked around the waist of the wearer.

6. The three-position child carrier in accordance with claim 1, further comprising:

a pocket is positioned on the front surface and fastened to the left edge, the right edge, and the bottom edge, the pocket further comprising a top edge that is contoured cut.

7. The three-position child carrier in accordance with claim 1, the top edge is cut in a convex curve shape with respect to a horizontal reference line.

8. The three-position child carrier in accordance with claim 1, the left edge, and the right edge is cut in a concave curved shape with respect to a vertical reference line.

9. The three-position child carrier in accordance with claim 1, the fold stitch is stitched in a concave curved shape with respect to a horizontal reference line.

10. The three-position child carrier in accordance with claim 1, the folded edge formed along the fold stitching when the top edge is folded down is a concave curved shape with respect to a horizontal reference line.

11. The three-position child carrier in accordance with claim 1, wherein the first shoulder strap buckle receiver, the second shoulder strap buckle receiver, and the buckle receiver are interchangeable for buckles, and the first buckle and the second buckle are interchangeable for buckle receivers such that the shoulder strap interconnects and secures the body portion in the front-carry position and the back-carry position and the shoulder strap interconnects with itself forming a continuous loop in the hip-carry position.

12. A three-position child carrier comprising:

a body portion that is made of a material that is flexible, the body portion comprising a front surface, a back surface, a top edge, a left edge, a right edge, a fold stitching, an upper channel stitching, a bottom edge channel stitching, and a bottom edge;

a first tether strap comprising a first shoulder strap buckle receiver on one end, the first tether strap is fastened to the body portion proximate the left edge below the fold stitching;

a second tether strap comprising a second shoulder strap buckle receiver on one end, the second tether strap is fastened to the body portion proximate the right edge below the fold stitching;

an upper channel is formed by folding the flexible material creating the top edge or adding second piece of the flexible material and stitching along the fold stitching and the upper channel stitching;

a lower channel is formed by folding the flexible material creating the bottom edge or adding second piece of the flexible material and stitching along the bottom channel stitching and selectively stitching along the bottom edge;

a shoulder strap is fitted through the upper channel, the shoulder strap comprising a webbing strap having a first end, a second end, a first buckle is secured to the first end, a second buckle is secured to the second end, and a buckle receiver is attached between the first buckle and the second buckle; and a waist strap is fitted through the lower channel, the waist strap comprising a waist webbing strap having a first waist webbing strap end and a second waist webbing strap end, a waist buckle is secured to the first waist webbing strap end and a waist buckle receiver is secured to the second waist webbing strap end, the waist buckle and the waist buckle receiver interconnect around the waist of a wearer;

wherein the three-position child carrier transitions to a front-carry position by interconnecting the first shoulder strap buckle receiver and the second buckle, and interconnecting the second shoulder strap buckle receiver and the first buckle in a crisscross pattern across the back of the wearer, the buckle receiver is left unconnected in the front-carry position; or wherein the three-position child carrier transitions to a back-carry position by interconnecting the first shoulder strap buckle receiver and the first buckle, and interconnecting the second shoulder strap buckle receiver and the second buckle over each shoulder of the wearer, the buckle receiver is left unconnected in the back-carry position; or wherein the three-position child carrier transitions to a hip-carry position by interconnecting the buckle receiver and the second buckle over one shoulder of the wearer, each of the first buckle, the first shoulder strap buckle receiver, and the second shoulder strap buckle receiver is left unconnected in the hip-carry position.

13. The three-position child carrier in accordance with claim 12, the flexible material is at least one of the following: a fabric, a foam, a rubber, a film, a plastic, water-resistant, heat-resistant, wind-resistant, fire-resistant, or a polymer.

14. The three-position child carrier in accordance with claim 12, further comprising:

a first fastener pair is located on each side of the fold stitch proximate to the top edge and right edge; and a second fastener pair is located on each side of the fold stitch proximate to the top edge and left edge, the top edge folds along the fold stitching forming a folded edge along the fold stitching and is secured by the first fastener pair and the second fastener pair.

15. The three-position child carrier in accordance with claim 12, the shoulder strap further comprising:

a shoulder strap cover; and a shoulder strap pad having a shoulder strap pad top surface and a shoulder strap pad bottom surface, the shoulder strap cover covers the shoulder strap pad, the webbing strap attaches, on the outside of the shoulder strap cover to the shoulder strap pad top surface, the first buckle, the second buckle, and the buckle receiver are accessible to the wearer, the shoulder strap pad and shoulder strap cover combination forms a flap at each end that rests beneath the first buckle, the second buckle, and the buckle receiver when interlocked with the second buckle.

16. The three-position child carrier in accordance with claim 12, the waist strap further comprising:

a waist strap cover; and a waist strap pad having a waist strap pad top surface and a waist strap pad bottom surface, the waist strap cover covers the waist strap pad, the waist webbing strap attaches, on the outside the waist strap cover, to the waist strap pad top surface, the waist buckle and the waist buckle receiver are accessible to the wearer, the waist strap pad and the waist strap cover combination forms a waist strap flap at each end that rests beneath the waist buckle and the waist buckle receiver when interlocked around the waist of the wearer.

17. A method of using a three-position child carrier comprising the steps of:

transitioning a three-position child carrier to a front-carry position by interconnecting a first shoulder strap buckle receiver and a second buckle, and interconnecting a second shoulder strap buckle receiver and a first buckle in a crisscross pattern across the back of the wearer, a body portion comprising a front surface, a back surface, a top edge, a left edge, a right edge, a fold stitching, an upper channel stitching, a bottom channel stitching, and a bottom edge, a first tether strap comprising the first shoulder strap buckle receiver on one end, the first tether strap is fastened to the body portion proximate the left edge below the fold stitching, a second tether strap comprising the second shoulder strap buckle receiver on one end, the second tether strap is fastened to the body portion proximate the right edge below the fold stitching, an upper channel is formed between the fold stitching and the upper channel stitching, a lower channel is formed between the bottom edge and the bottom channel stitching, a shoulder strap is fitted through the upper channel, the shoulder strap comprising a webbing strap having a first end, a second end, the first buckle is secured to the first end, the second buckle is secured to the second end, and a buckle receiver is attached between the first buckle and the second buckle, the buckle receiver is left unconnected in the front-carry position; or transitioning the three-position child carrier to a back-carry position by interconnecting the first shoulder strap buckle receiver and the first buckle, and interconnecting the second shoulder strap buckle receiver and the second buckle over each shoulder of the wearer, the buckle receiver is left unconnected in the back-carry position; or transitioning the three-position child carrier to a hip-carry position by interconnecting the buckle receiver and the second buckle over one shoulder of the wearer, each of the first buckle, the first shoulder strap buckle receiver, and the second shoulder strap buckle receiver is left unconnected in the hip-carry position; and securing a waist strap around the waist of a wearer, the waist strap is fitted through the lower channel, the waist strap comprising a waist webbing strap having a first waist webbing strap end and a second waist webbing strap end, a waist buckle is secured to the first waist webbing strap end and a waist buckle receiver is secured to the second waist webbing strap end, the waist buckle and the waist buckle receiver interconnect.

18. The method in accordance with claim 17, further comprising the step of:

adjusting the length of the waist strap by repositioning the waist buckle or the waist buckle receiver.

19. The method in accordance with claim 17, further comprising the step of:

adjusting the length of the shoulder strap by repositioning the second buckle or the buckle receiver.

20. The method in accordance with claim 17, wherein the first shoulder strap buckle receiver, the second shoulder strap buckle receiver, and the buckle receiver are interchangeable for buckles, and the first buckle and the second buckle are interchangeable for buckle receivers such that the shoulder strap interconnects and secures the body portion in the front-carry position and the back-carry position and the shoulder strap interconnects forming a continuous loop in the hip-carry position.

* * * * *